US009737122B1

(12) United States Patent
Ives et al.

(10) Patent No.: US 9,737,122 B1
(45) Date of Patent: Aug. 22, 2017

(54) CONVERTIBLE BACKPACK HANDBAG

(71) Applicants: Mari Christine Ives, Portland, OR (US); Kathleen Anne McInroe, West Linn, OR (US)

(72) Inventors: Mari Christine Ives, Portland, OR (US); Kathleen Anne McInroe, West Linn, OR (US)

( * ) Notice: Subject to any disclaimer, the term of this patent is extended or adjusted under 35 U.S.C. 154(b) by 0 days.

(21) Appl. No.: 15/233,846

(22) Filed: Aug. 10, 2016

Related U.S. Application Data

(60) Provisional application No. 62/203,785, filed on Aug. 11, 2015.

(51) Int. Cl.

| | |
|---|---|
| ***A45C 9/00*** | (2006.01) |
| ***A45F 3/04*** | (2006.01) |
| ***A45F 4/02*** | (2006.01) |
| ***A45C 1/02*** | (2006.01) |
| ***A45C 13/10*** | (2006.01) |

(52) U.S. Cl.
CPC ..... *A45C 9/00* (2013.01); *A45C 1/02* (2013.01); *A45C 13/10* (2013.01); *A45F 3/04* (2013.01); *A45F 4/02* (2013.01); *A45C 2009/007* (2013.01)

(58) Field of Classification Search
CPC .... A45F 2004/023; A45C 7/00; A45C 7/0095
USPC ..... 224/579, 580, 581
See application file for complete search history.

(56) References Cited

U.S. PATENT DOCUMENTS

| | | | | | |
|---|---|---|---|---|---|
| 3,019,952 | A * | 2/1962 | Brewster | A45C 3/00 | 224/153 |
| 3,622,056 | A * | 11/1971 | Droeger | A45F 3/04 | 224/153 |
| 4,273,274 | A | 6/1981 | Freistadt | | |
| 5,002,401 | A * | 3/1991 | Blackman | A45C 7/0095 | 150/112 |
| 5,490,619 | A | 2/1996 | Boyar | | |
| 5,544,792 | A * | 8/1996 | Arnwine | A45C 7/0086 | 224/153 |
| 5,615,812 | A * | 4/1997 | Martin | A45F 3/04 | 224/153 |
| 5,676,293 | A * | 10/1997 | Farris | A45F 3/04 | 2/175.7 |
| 5,695,101 | A * | 12/1997 | Frietze | A45F 3/14 | 224/250 |
| 5,797,529 | A | 8/1998 | Lavine | | |
| 6,354,477 | B1 * | 3/2002 | Trummer | A45C 3/02 | 224/153 |
| 6,460,746 | B1 * | 10/2002 | Amram | A45F 3/047 | 224/579 |
| 6,889,882 | B1 * | 5/2005 | Leep | A45F 3/08 | 224/160 |
| 7,160,028 | B1 | 1/2007 | Linday | | |

(Continued)

*Primary Examiner* — Brian D Nash
(74) *Attorney, Agent, or Firm* — Bert P. Krages, II

(57) ABSTRACT

A convertible carrying device in which the straps may be selectively secured to configure the device as a backpack or as a handbag. In the handbag configurations, the selective securing of the straps effectuates differing functional strap lengths enabling the handbag to be carried by hand, over a shoulder, or cross body. The arrangement of the connection points on the bag and the straps applies directional forces to the placket surrounding the opening that make it adopt a valley shape when in a handbag configuration and a planar orientation when in the backpack configuration.

19 Claims, 8 Drawing Sheets

(56) References Cited

U.S. PATENT DOCUMENTS

| | | | | |
|---|---|---|---|---|
| 2002/0145018 | A1* | 10/2002 | Godshaw | A45F 4/02<br>224/153 |
| 2010/0006613 | A1 | 1/2010 | Burns | |
| 2012/0267017 | A1 | 10/2012 | Sloan | |
| 2014/0150936 | A1 | 6/2014 | Goodale | |
| 2016/0015155 | A1* | 1/2016 | Patel | A44B 19/382<br>224/581 |

* cited by examiner

CONVERTIBLE BACKPACK HANDBAG

CROSS-REFERENCED TO RELATED APPLICATIONS

This application claims the benefit of provisional application 62/203,785 which was filed on Aug. 11, 2015.

FIELD OF THE INVENTION

The invention relates generally to the field of handbags and backpacks.

BACKGROUND OF THE INVENTION

Handbags and backpacks serve the common purpose of providing a means for carrying goods and articles. However, the fact that they have different configurations has implications regarding functionality and fashion.

Among the advantages of backpacks are that they allow the user to carry the bag on their back with the weight evenly distributed on the shoulders and they allow the user to have both hands free. This provides the most comfortable and practical means of carrying a bag when engaged in activities such as bicycling, sustained walking, tending to or carrying a child or any activity that would be hindered by a handbag swinging from a shoulder, worn across the front of the body or being hand held. However, the contents of traditional backpacks are too easily accessible to pickpockets and traditional backpacks are too casual to be appropriate in many situations.

Handbags have had an advantage over backpacks in that there has been greater flexibility in design which makes them appropriate in any situation and more compatible with any given fashion or look. However, a handbag, whether hand held, carried on one shoulder, or worn cross body can cause back and shoulder pain when carried for long periods. A handbag also interferes with the ability to enjoy many activities even of shorter duration because it requires that the user actively hold the bag or deal with gravity caused swinging if the wearer leans forward. While traditional backpacks usually have a small handle at the top so that the backpack may be carried by hand, it is a backpack by configuration and therefore cannot share the advantages of a handbag's design flexibility as described above.

Depending on the nature and duration of an outing, wearers may prefer one type of bag over the other for all or a portion of the outing. For example, a long walking tour would likely call for a backpack. If that day of touring involves entry into an establishment (such as a museum) which prohibits backpacks but allows handbags, or culminates in arrival at a destination demanding a fashion look more refined than a backpack, there is a need for a fashionable bag that can be easily converted between the backpack and handbag modes

SUMMARY OF THE INVENTION

The present invention is a combination handbag and backpack that can be selectively converted into a backpack, shoulder bag (which can also be held by hand), or cross body bag. In any of its handbag modes, the invention conveys a handbag aesthetic and exhibits none of the look or configuration of a traditional backpack. In addition, the invention has security features in the form of a retractable leash with a clip for tethering to objects and a swivel hook on the zipper pull which attaches to a D ring on the bag The preferred embodiment of the invention comprises a bag having upper, middle, and lower sets of D rings and an upper set and lower set of buttons on either side of the bag. The top opening of the bag is set within a placket formed by two longitudinal sections of fabric attached to each longitudinal edge of the bag opening and connected by a zipper. In the preferred embodiment, the placket is wider and shorter than the zipper and both ends of the zipper placket are free. Because of the placement of the buttons and rings on the bag, the direction of the forces on the placket differ depending on whether bag is in a handbag mode or a backpack mode. Thus, when in shoulder bag or cross body bag mode, this placket forms a valley shape. However, the placket lays flat when in backpack mode. The different configurations of the placket depending on the mode enhance security because the recessed position of the opening when in a cross body or shoulder bag mode is better protected than a nonrecessed opening and the flattened placket in backpack mode faces the wearer's back where it is significantly less accessible to persons standing behind the wearer than an opening that faces away from the wearer.

The bag may optionally contain a pocket on the front of the bag that protrudes from the face of the bag such as a pouch or bellows pocket, and may also have a flat pocket on the back of the bag that is constructed substantially flush with the face of the bag, such as a patch or jetted pocket. The advantage of the flat pocket on the back side is that it does not press uncomfortably against the wearer's back and the front pocket provides more depth for storing items.

The preferred embodiment further comprises two straps which have clips at both ends, two slots at one end, and three slots at the other end. The clips can be attached to the D rings and the slots to the buttons in various ways to configure the bag as a backpack, shoulder bag, or cross body bag.

In backpack mode, the first strap is attached by connecting the clip on the end having three slots to one of the lower center "D" rings on the front of the bag and then inserting the button that is located below the D ring into the slot closest to the end of the strap. The strap is then passed under the bottom of the bag to the back side of the bag wherein the button at the bottom of that side of the bag is inserted into the third slot from the end of the strap. The strap is then passed over the back and top of the bag and then attached by inserting the button at the top front of the bag into the slot closest to the other end of the strap. The attachment process for the strap is completed by attaching the remaining clip to the upper center "D" ring. The process is repeated with the second strap beginning with the opposite lower D ring on the front of the bag. When the straps are configured in this way, the wearer can insert his or her arms through the openings created between the straps and the bag and thus wear the bag as a backpack.

A notable feature of the bag is that it requires only two straps, of equal length and identical in other aspects, to facilitate the conversion into the different modes. In each mode, the straps are attached to the outside of the bag and thus do not consume any interior space. The particular arrangement of the straps and the various points of connection on the bag enable the use of straps that have sufficient length to accommodate the conversions and maintain conventional effective length in each of the modes.

To convert to cross body mode, the straps are detached from the bag and then reattached one at a time. The first strap is attached by clipping one end of the strap to one of the D rings in the upper corner of the bag and then clipping the other end to the D ring on the other upper corner of the same side of the bag. The same process is repeated for the second strap on the other side of the bag. When the bag is configured in the cross body mode, the placket forms a valley in which the zipper is positioned at the bottom. This allows the wearer ready access to the zipper to open and close the bag but makes it more difficult for other persons, such as pickpockets, to access the opening.

The bag is likewise easy to convert to a shoulder or handheld bag. To do so, the straps are detached from the bag. The first strap is attached by clipping one end of the strap to one of the D rings in the lower corner of the bag and inserting the button at the corresponding upper corner into the second slot from the end of the strap. The other end of the strap is then clipped to the D ring on the other lower corner of the same side of the bag and the button at the corresponding upper corner is inserted into the second slot from the end of that end of the strap. The same process is repeated for the second strap on the other side of the bag. When the bag is configured in this mode, the placket forms a valley in the same way that it does when the bag is configured in cross body mode.

The proportions of the bag are the dominant factor that determine the location of the buttons and the slots in the straps. The slots can be constructed at different distances to accommodate the dimensions of the bag. The second slot at each end of the strap will generally be the same distance from the ends of the straps, that distance corresponding to the distance between the buttons at the top of the bag and the lowest D rings. The exception would be if the straps are used with bags having ends of different heights. The first slots at either end may be set at different distances from the ends to facilitate the conversion to backpack mode. The distance between the lower middle D ring and the lower button on the front of the bag can be different than the distance between the upper center D ring and the upper button on the front of the bag. The backpack mode requires that each strap wrap around the bag with its two ends meeting at the center D rings. Likewise, the distance from the end of a strap to the third slot is determined by the distance between the lower middle D ring on the front of the bag and the lower button on the back of the bag, as measured around the bottom of the bag. In the case where the distance from the lowest D ring to the upper button is the same as the distance between the lower middle D ring on the front side of the bag to the lower button on the back side of the bag, a third slot will not be necessary.

Various kinds of buttons are suitable for effecting the connection with the strap, including flat buttons, shank buttons, stud buttons, studs, and toggles. In addition to fashion concerns, the decision to use particular types of button will depend in part on the flexibility, width, and thickness of the material used to construct the straps.

Although the preferred embodiment uses button and slot combinations and clip and D ring combinations to attach the straps to the bag, there are other fasteners and means of fastening that constitute connectable elements that can be used to accomplish the conversion between modes. Examples of connectable elements include buttons, slots, clips, circular rings, rectangular rings, flexible loops, rigid loops, snap fasteners, belt loops, hooks, buckles, clamps, clasps, tieable or bindable cords, twist ties, bayonet fittings, Chicago screws, grommets, and chocks. Instead of using button and slot combinations or clip and ring combinations, other combinations of connectable elements that can be used include snap fasteners, belt loop and strap, hook and eye, hook and loop, buckle and strap, cords and tie point, bayonet fitting, Chicago screw and hole, and chock and retainer. In addition, the button and slot combination can be reversed so that the buttons are on the straps and slots are constructed on the bag. The clip and ring combination can similarly be reversed. In some instances, the combination of buttons and clips at the corners of the bag could be replaced with a single connectable element combination such as a single button at the corners of the bag with a corresponding single slot at the ends of the straps and slots located at appropriate places away from the ends. Similarly, the combination of two D rings at the middle of the front of the bag could be replaced by a single button over which both ends of a strap are secured when the bag is configured in backpack mode.

In addition to the security features described above, the bag can be equipped with a retractable leash with a clip in which the reel is attached to a pocket at one end of the bag. This enables the wearer to conveniently and securely attach the leash to an object such as a chair leg when the bag is not being worn. Another security feature is that the pull tab of the zipper can be equipped with a clip that attaches to a loop and thus makes it more difficult for a pickpocket to open the zipper without being noticed by the wearer.

DETAILED DESCRIPTION OF THE PREFERRED EMBODIMENT

Figure 1:
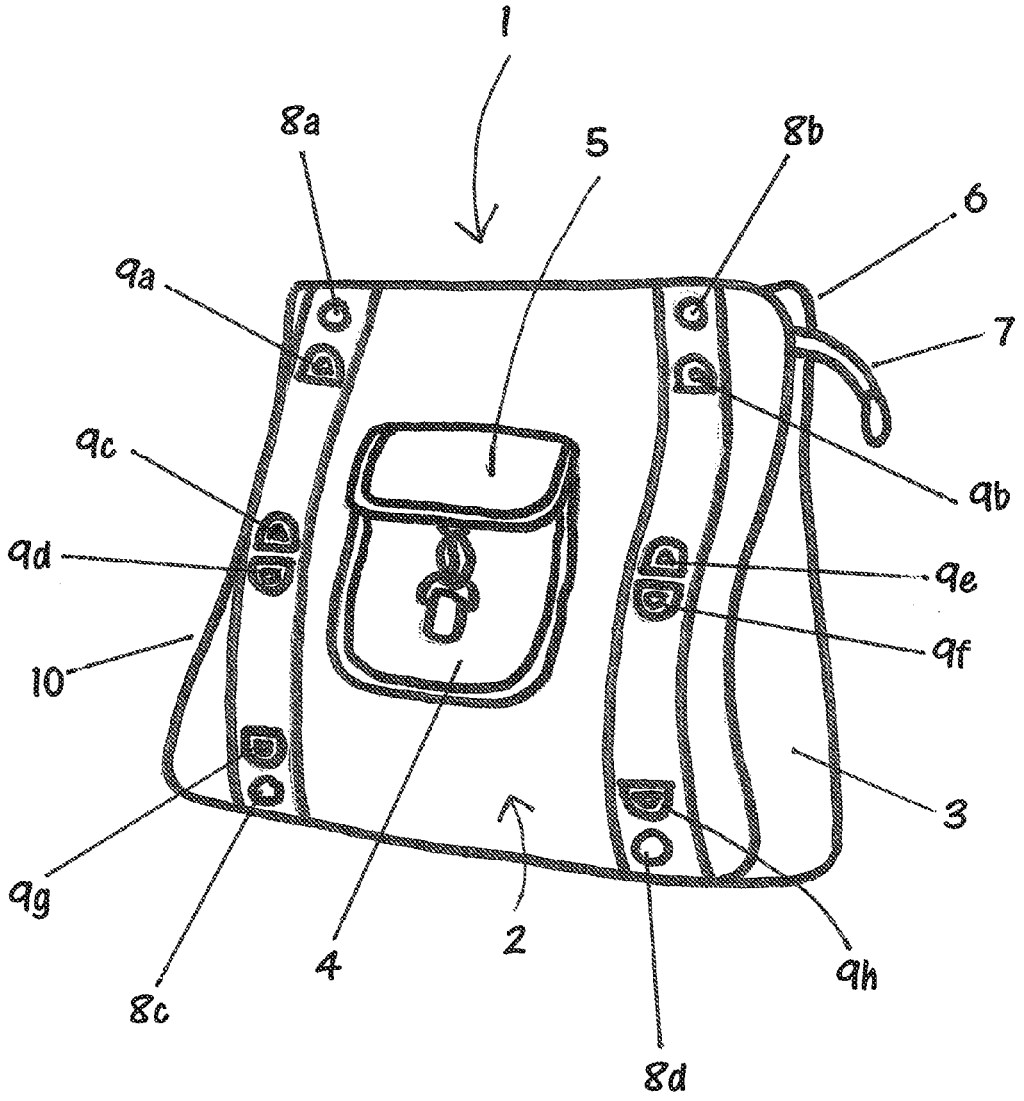
FIG. 1 is a perspective view of the bag from the front side.

FIG. 1 shows the front side 2 of the preferred embodiment of the bag 1 as well as the plain end 3 which does not have pockets or attachment points. The opposite end 10 of the bag may be fitted with features that are shown in later figures. The front side 2 features a pocket 4 with a flap 5 that protrudes from the face of the front side 2. A zipper 7 is located at the top of the bag and permits access to the interior. When the bag is in shoulder bag or cross body mode, the upper part 6 of the bag 1 will be positioned higher than the zipper 7. The front side 2 of the bag 1 has buttons 8*a* & 8*b* at the top corners of the bag and has buttons 8*c* & 8*d* at the bottom corners. As is shown later, these buttons are used to attach straps to the bag 1 in various configurations. The front side 2 of the bag 1 also has D rings 9*a* & 9*b* at the upper corners, D rings 9*c* & 9*e* configured in an upward facing direction at near the middle edges of the bag, D rings 9*d* & 9*f* configured in a downward facing direction at near the middle edges of the bag, and D rings 9*g* & 9*h* at the bottom corners. The D rings 9*a-h* are sewn into the bag and are able to pivot around the straight portion of the rings. As is also shown later, the purpose of these rings is to allow straps to be attached to the bag 1 in various configurations.

Figure 4:
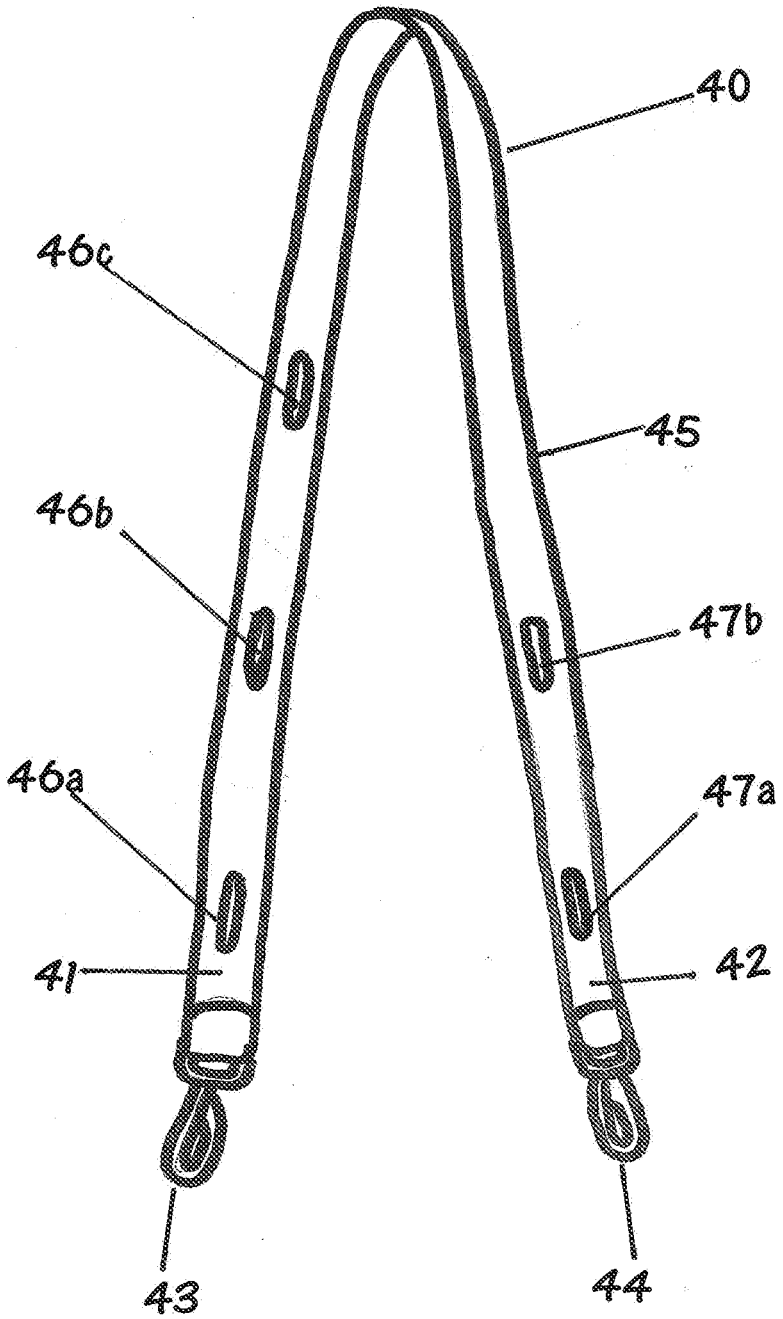
FIG. 4 is a side view showing both ends of a strap.

It should be noted that in the preferred embodiment as shown in FIG. 1, the connectable elements consist of combinations of buttons and D rings or combinations of D rings. For example, the first connectable element consists of button 8*a* and 9*a*, the second connectable element consists of D ring 9*c* and D ring 9*d*, the third connectable element consists of button 8*c* and D ring 9*g*, the fourth connectable element consists button 8*b* and D ring 9*b*, the fifth connectable element consists of D ring 9*e* and D ring 9*f*, and the sixth connectable element consists of button 8*d* and D ring 9*h*. The preferred embodiment uses these combinations because they work efficiently with the clips and slots of the straps as shown in FIG. 4. However, as noted in the section titled Summary of the Invention, other types of connectable elements, in the form of single fasteners or various combinations thereof, could be used on the bag and straps.

Figure 2:
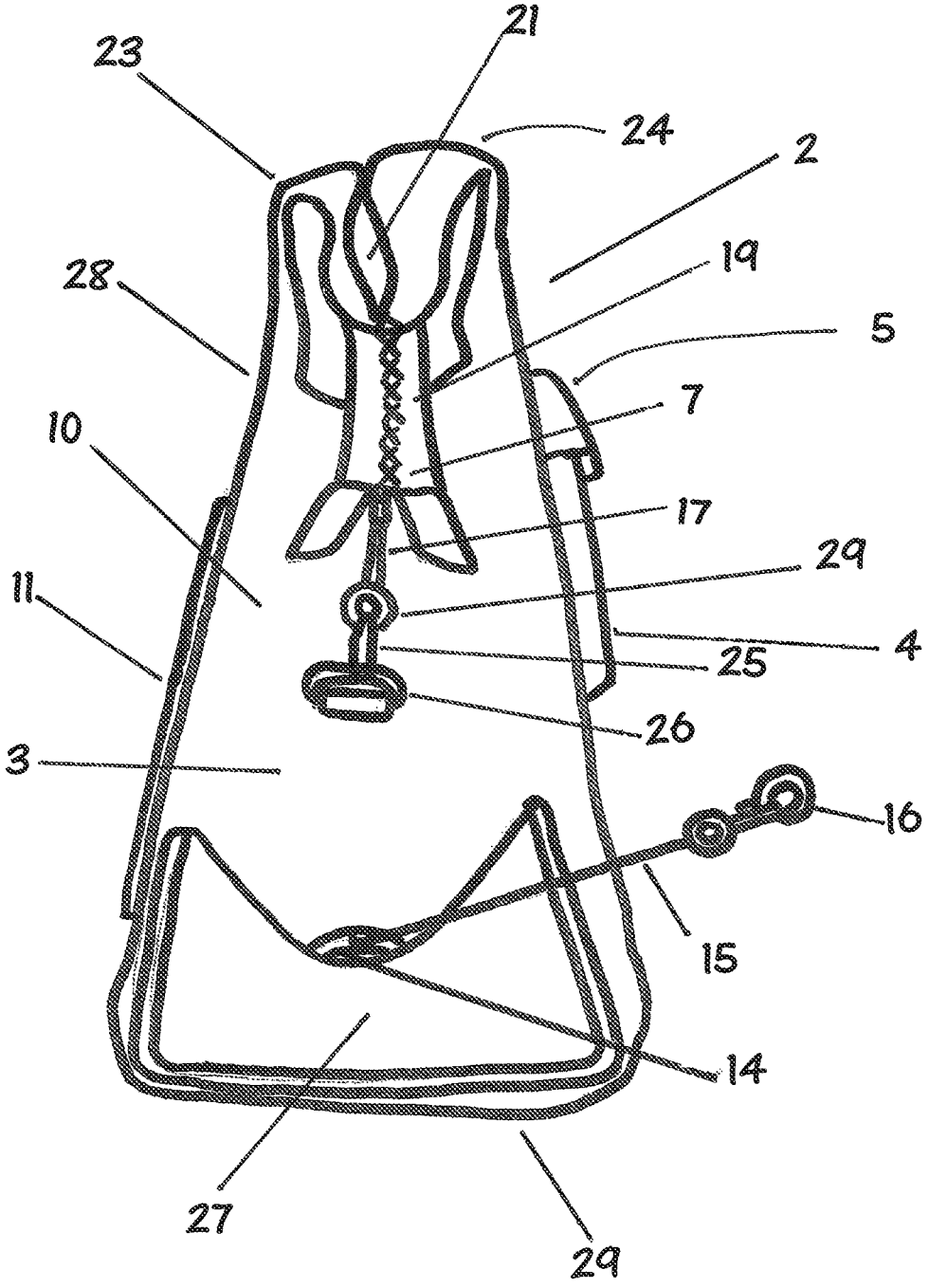
FIG. 2 is a side view of one end of the bag.

FIG. 2 shows the end 10 that has various features. A back-side strip 23 of fabric connects to the back upper edge of the bag on one side and to the zipper 7 on the other side. A front-side strip 24 similarly is connected to the front upper edge of the bag and zipper. Together, strips 23 and 24 and the zipper 7 form a placket 21 that forms a valley shape when in shoulder bag or cross body mode. The placket 21 is preferably constructed such that it is shorter and wider than the zipper 7 with the ends 19 free of the bag 1. When the zipper is closed, the zipper tab 17 will reside at on one of the ends 19. A clip 25 can be connected to the zipper tab 17 by a connecting ring 29. When the clip 25 is fastened to a D ring 26 that has been sewn to the bag, the bag is made even more secure from entry by pickpockets.

FIG. 2 also shows a pocket 27 in which a spring-loaded reel 14 is firmly secured to the bag. The reel 14 has a retractable cord 15 that is connected to a clip 16. The retractable cord 15 may be wrapped around an object with the clip 16 fastened to the D ring 26 when the bag is not being worn so as to deter theft. When the bag is not being worn so as to deter theft. Alternatively the clip 16 and end of the cord 15 may be wrapped around an object such as a chair leg or ankle after which the clip 16 is secured to the cord 15 so as to form a loop or noose.

Figure 3:
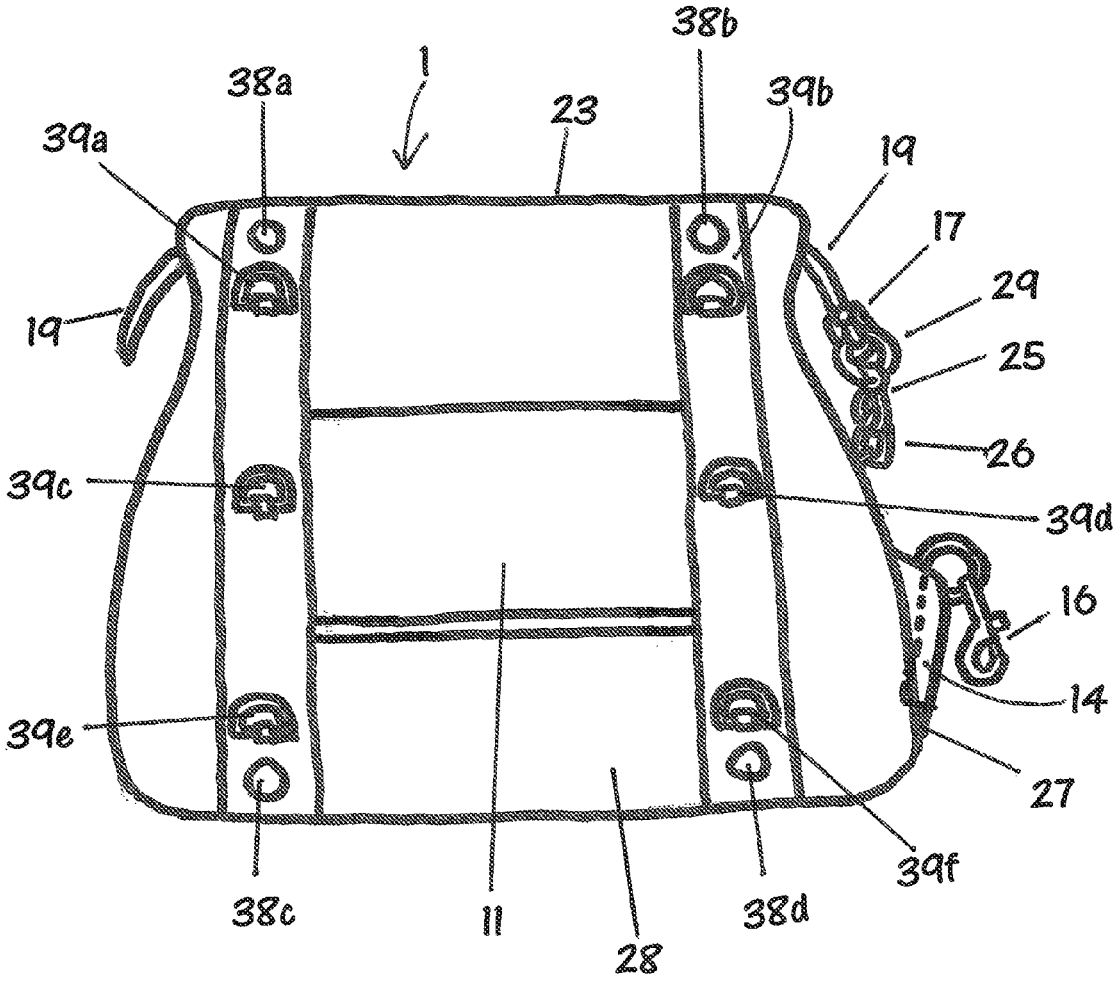
FIG. 3 is a front view of the back side of the bag.

FIG. 3 shows the back side of the bag 1. This side features a pocket 11 that is substantially flush with the bag. This side has buttons 38*a* & 38*b* at the top corners of the bag and has buttons 38 *c* & 38*d* at the bottom corners. As is shown later, these buttons are used to attach straps to the bag 1 in various configurations. The front side 2 of the bag 1 also has D rings 39*a* & 39*b* at the upper corners and D rings 39*e* & 39*f* at the bottom corners. As is also shown later, the purpose of these rings is to allow straps to be attached to the bag 1 in various configurations. There are also two D rings 39*c* & 39*d* near the middle edges of the bag. These rings are available as points of attachment for optional accessories such as tethers to objects the user may place in the pocket 11. The D rings 39*a-f* are sewn into the bag and are able to pivot around the straight portion of the rings.

FIG. 4 shows a strap 40. Three-slot end 41 has three slots 46*a*, 46*b*, & 46*c* which are spaced at distances that correspond to the various distances between the buttons 8*a-d* and 38*a-d* as shown on FIGS. 1 and 3. The three slot end 41 also has clip 43 that can fasten onto a D ring. The two-slot end 41 has two slots 47*a* &47*b* which is likewise spaced at distances that correspond to the various distances between the buttons 8*a-d* and 38*a-d* as shown on FIGS. 1 and 3. Slots 46*b* and 47*b* are spaced the same distance from their respective ends 41 & 42. This distance is the same distance as between button 8*a* and D ring 9*g*, button 8*b* and D ring 9*h*, button 38*a* and D ring 39*e*, and button 38*b* and D ring 39*f*, as shown on FIGS. 1 and 3. The purpose of the clips and slots is to serve as connectable elements for attaching the straps to the connectable elements on the bag. Although the straps 40 in the preferred embodiment use clips and slots, other forms of connectable elements can be used.

Figure 5:
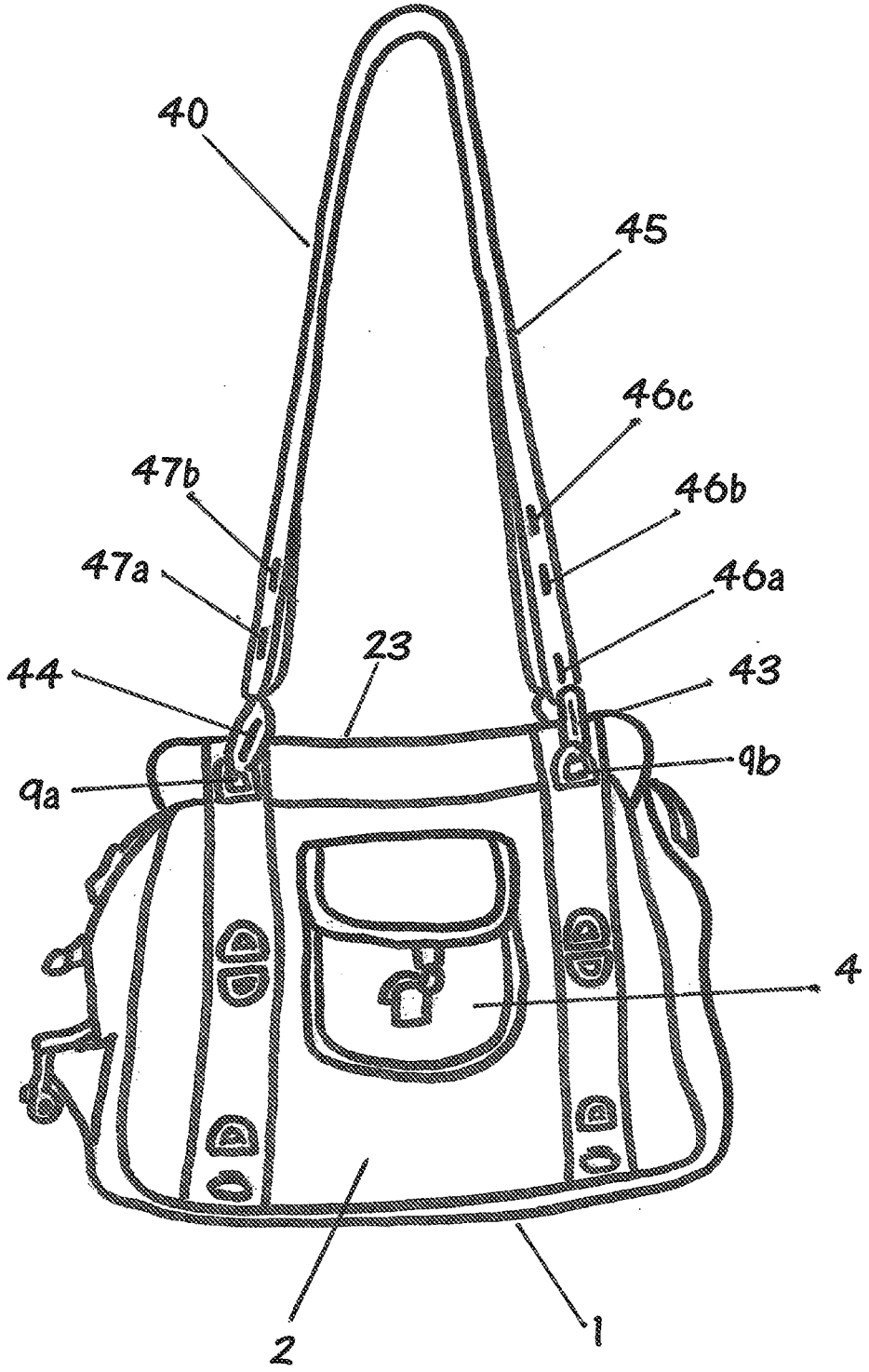
FIG. 5 is a front view of the front side of the bag in cross body mode.

The cross body mode is shown in FIG. 5. To convert the bag 1 into this mode, a strap 40 is connected to the bag by fastening the clips to the upper D rings on the front side and by connecting the other strap 40 to the upper D rings on the back side. For example, FIG. 5 shows the front side 2 of the bag 1 where clip 43 has been fastened to upper D ring 9*b* and clip 44 has been fastened to upper D ring 9*a*. The other strap 40 is fastened to upper D rings 39*a* & 39*b* on the other side of the bag 1 in the same manner (not shown in FIG. 6 but D rings 39*a* & 38*b* are shown in FIG. 3). When converting to the cross body mode, it does not matter whether clip 43 is fastened to D ring 9*a* or 9*b*, so long as it is fastened to one or the other, and clip 44 is fastened to the remaining D ring. The placement of D rings 9*a* & 9*b* at or above the level of the zipper 7 causes the placket to assume a valley shape shown in FIG. 2 where the strips 23 & 24 fold at the top and the zipper 7 resides at the bottom of the placket 21.

Figure 6:
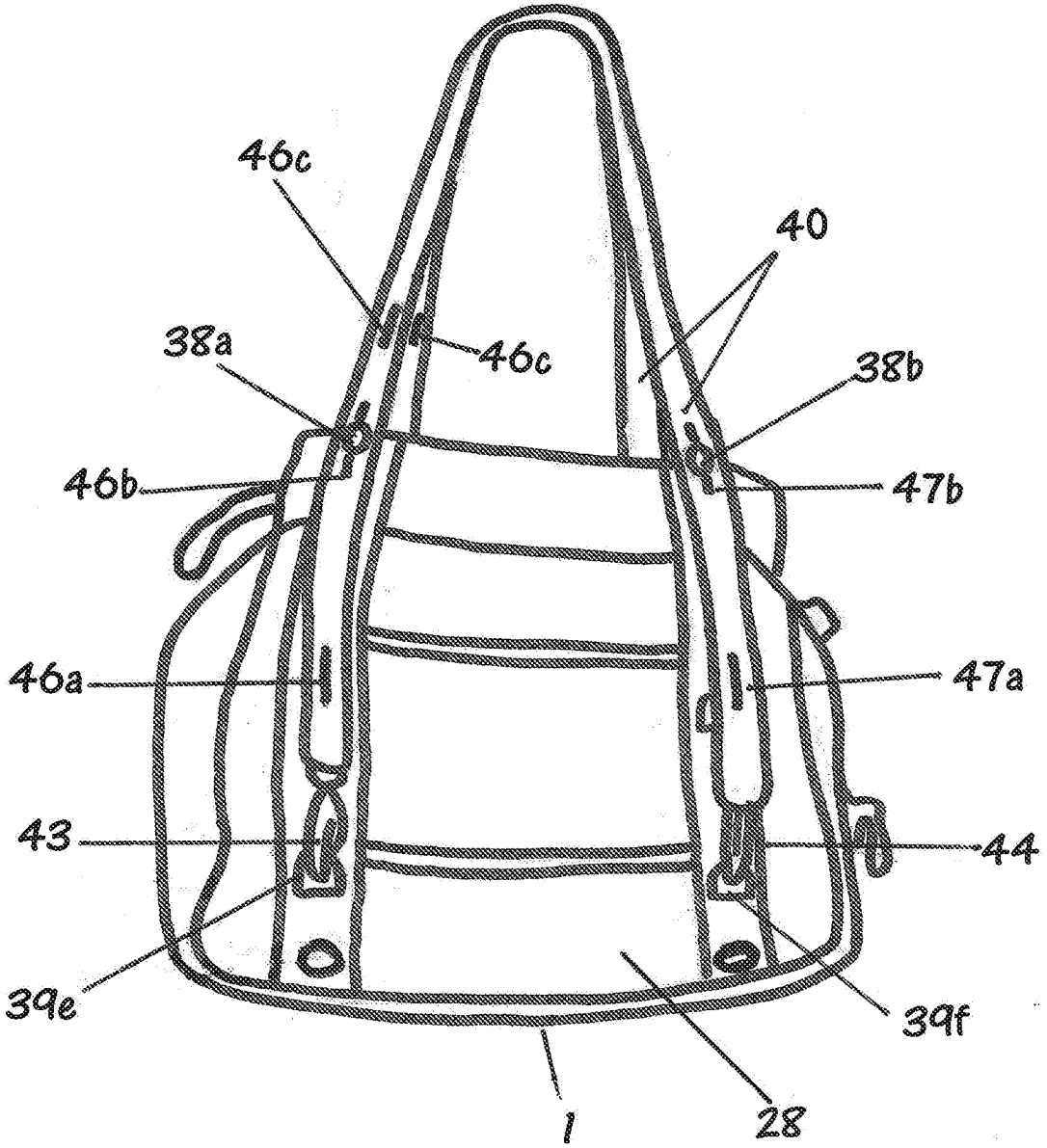
FIG. 6 is a front view of the back side of the bag in shoulder bag mode.

The shoulder bag mode is shown in FIG. 6, this time from back side 28 of the bag 1. To convert the bag 1 to shoulder bag mode, the strap 40 is fastened to the bag 1 by inserting upper corner button 38*a* through slot 46*b* and then fastening clip 43 onto the lower D ring 39*e*. Next, upper button 38*b* is inserted through slot 47*b* and clip 44 is fastened to lower D ring 39*f*. The same steps are repeated for the other side of the bag except that a strap 40 is fitted to upper buttons 8*a* & 8*b* and lower D rings 9*g* & 9*h* as shown on FIG. 1. In the shoulder bag mode, the placement of buttons 38*a* & 38*b* at or above the level of the zipper 7 will cause the placket to assume the valley shape shown in FIG. 2 where the strips 23 & 24 fold at the top and the zipper 7 resides at the bottom of the placket 21.

Figure 7:
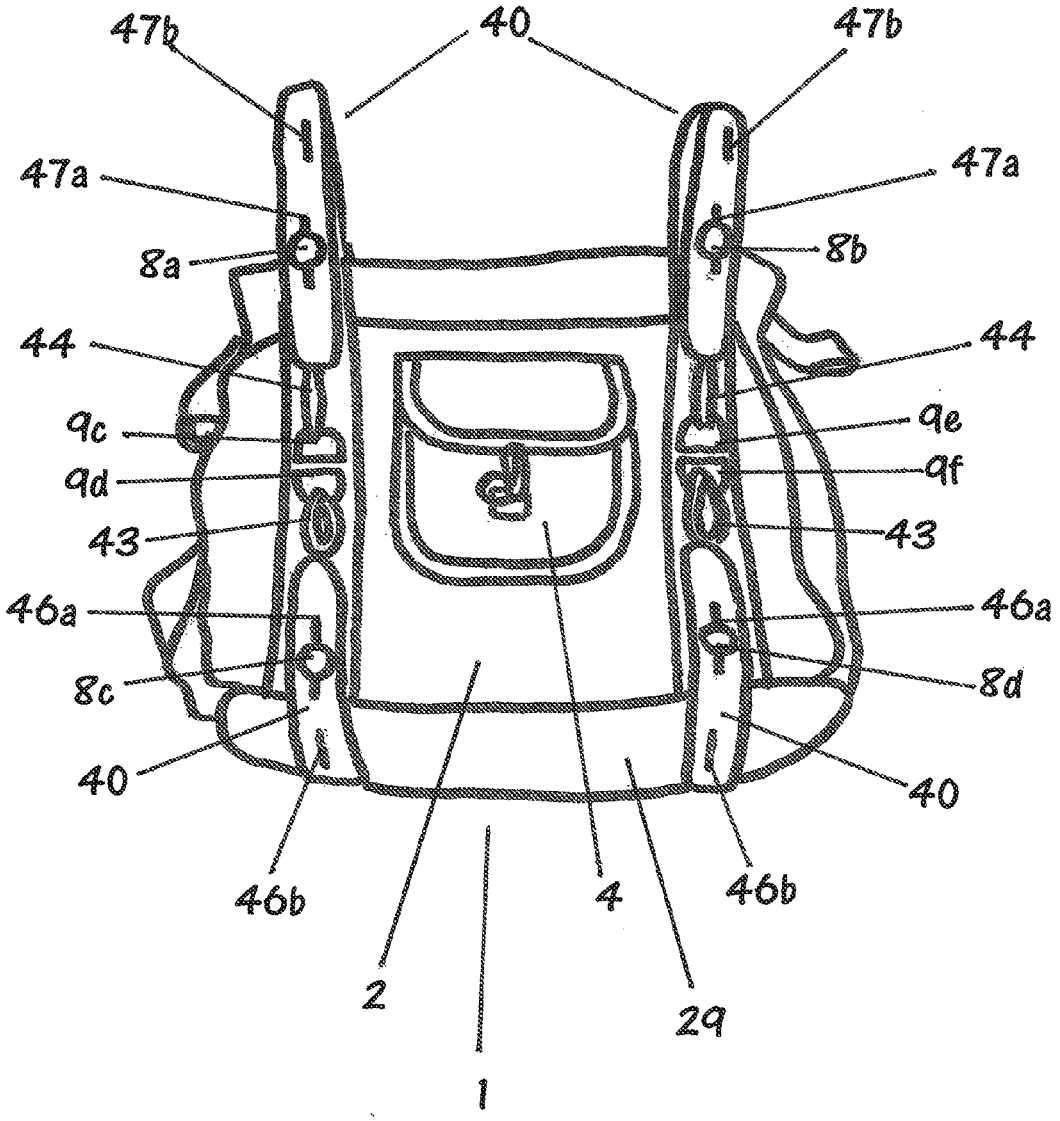
FIG. 7 is a front view of the front side of the bag in backpack mode.
Figure 8:
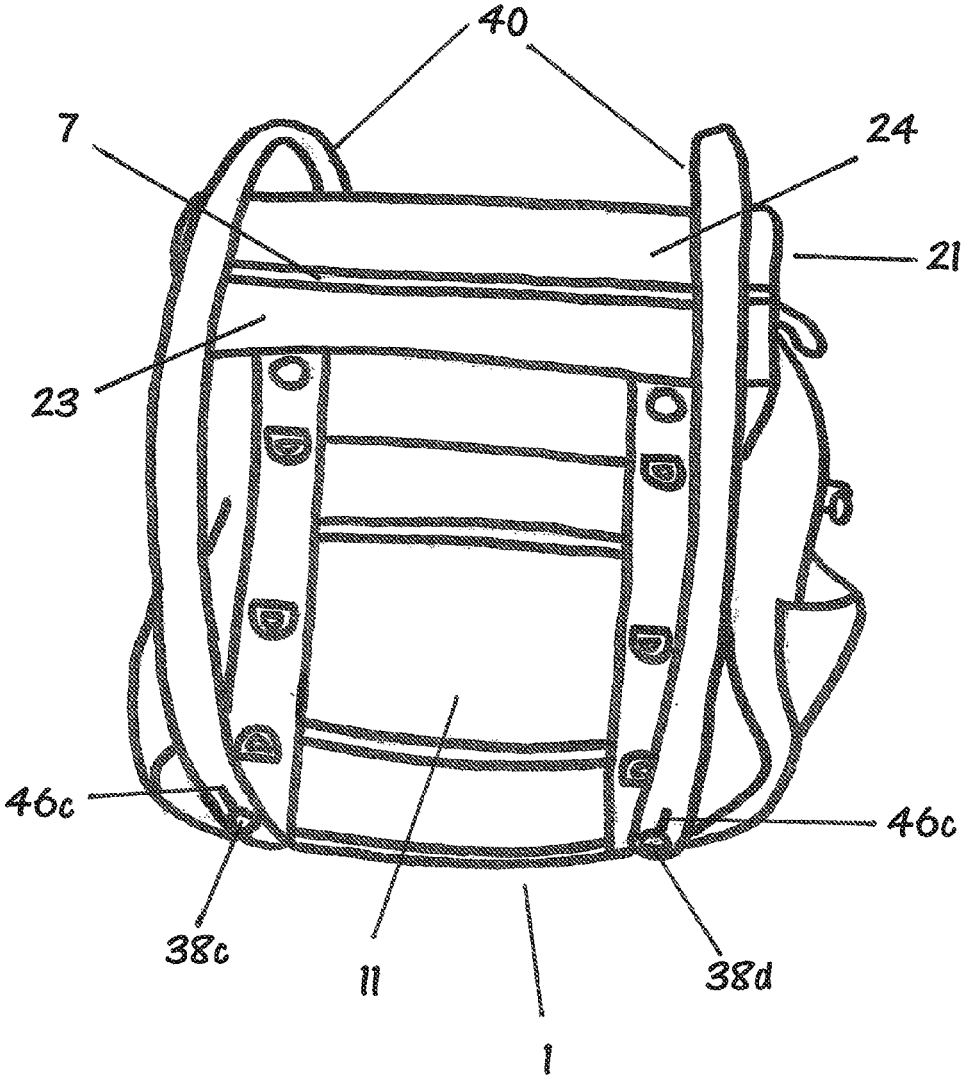
FIG. 8 is a front view of the back side of the bag in backpack mode.

Conversion into the backpack mode is shown on FIGS. 7 and 8. One of the straps 40 is fastened to the bag 1 by inserting lower front button 8*c* into slot 46*a* and attaching clip 43 to lower middle D ring 9*d*. The strap 40 is passed over the bottom 29 of the bag 1 and lower back button 38*c* is inserted into slot 46*c*. The strap 40 is passed over the back of the bag and around to the front 2 of the bag 1 and upper button 8*a* is inserted thorough slot 47*a*. Clip 44 is then attached to upper middle D ring 9*c*. The other strap 40 is fastened to the bag 1 by inserting lower front button 8*d* into slot 46*a* and attaching clip 43 to lower middle D ring 9*f*. The strap 40 is passed over the bottom 29 of the bag 1 and lower back button 38*d* is inserted into slot 46*c*. The strap 40 is passed over the back of the bag and around to the front 2 and upper button 8*b* is inserted thorough slot 47*a*. Clip 44 is then attached to upper middle D ring 9*e*. When the straps are fastened in this manner, a wearer can insert his or her arms through the openings between the straps 40 and the back of the bag 1 and wear the bag as a backpack.

A notable feature of the bag is that the zipper 7 is not readily accessible to a person standing behind the wearer because the arrangement of the connection of the straps 40 to the buttons 8*a*, 8*b*, 8*c*, 8*d*, 38*c*, and 38*d* causes the placket 21 to flatten out when the backpack is worn such that backside strip 23 and the front side strip 24 that form the placket become configured in a generally planar orientation and face the backside of the wearer. The preferred embodiment has a protruding front pocket 4 and a substantially flush back pocket 11. This arrangement allows for the storage of various items in the front pocket 4 and the storage of substantially flat items in the back pocket 11 without the discomfort to the wearer caused by a pocket poking into the back. In addition, the back pocket 11 is relatively protected from pickpockets.

While the present invention has been described with regard to the preferred embodiments, it should be understood that the invention is not limited to these embodiments and a number of variations and modifications can be made to the structure described above without departing from the spirit and scope of the present invention.

We claim:

1. A convertible bag for transporting articles comprising:

a bag body having a front side, back side, right side, left side, bottom, and a top opening;

said front side having a first upper button, a first lower button, a first upper ring, a first upper middle ring, a first lower middle ring, and a first lower ring, said rings generally aligned vertically along a first portion of the front side;

said front side having a second upper button, a second lower button, a second upper ring, a second upper middle ring, a second lower middle ring, and a second lower ring, said rings generally aligned vertically along a second portion of the front side;

said back side having a first upper button, a first lower button, a first upper ring, and a first lower ring, said rings generally aligned vertically along a first portion of the back side;

said back side having a second upper button, a second lower button, a second upper ring, and a second lower ring, said rings generally aligned vertically along a second portion of the back side;

a first strap having a first end and a second end, a first clip at the first end, a second clip at the second end, a first proximal slot near the first end, one or more first distal slots at positions beyond the first proximal slot, a second proximal slot near the second end, and a second distal slot at a position beyond the second proximal slot;

a second strap having a first end and a second end, a first clip at the first end, a second clip at the second end, a first proximal slot near the first end, one or more distal slots at positions beyond the first slot, a second proximal slot near the second end, and a second distal slot at a position beyond the second proximal slot;

wherein, said first and second straps are connected to the bag body in a configuration selected from the group consisting of cross body configuration, shoulder bag configuration, and backpack configuration;

wherein said cross body configuration comprises the first clip of the first strap fastened to the first upper ring of the front side and the second clip of the first strap fastened to the second upper ring of the front side, and the first clip of the second strap fastened to the first upper ring of the back side and the second clip of the second strap fastened to the second upper ring of the back side;

wherein said shoulder bag configuration comprises the first clip of the first strap fastened to the first lower ring, one of the first distal slots of the first strap fastened to the first upper button of the front side, the second distal slot of the first strap fastened to the second upper button of the front side, and the second clip of the first strap fastened to the second lower ring of the front side, and the first clip of the second strap fastened to the first lower ring of the back side, one of the first distal slots of the second strap fastened to the first upper button of the back side, the second distal slot of the second strap fastened to the second upper button of the back side, and the second clip of the second strap fastened to the second lower ring of the back side; and wherein said backpack configuration comprises the first clip of the first strap fastened to the first lower middle ring on the front side of the bag body, the first proximal slot of the first strap fastened to the first lower button on the front side of the bag body, one of the first distal slots of the first strap fastened to the first lower button on the back side of the bag body, the second proximal slot of the first strap fastened to the first upper button of the front side of the bag body, and the second clip of the first strap fastened to the first upper middle ring on the front side of the bag; and the first clip of the second strap fastened to the second lower middle ring on the front side of the bag, the first proximal slot of the second strap fastened to the second lower button on the front side of the bag body, one of the first distal slots of the second strap fastened to the second lower button on the back side of the bag body, the second proximal slot of the second strap fastened to the second upper button of the front side of the bag body, and the second clip of the second strap fastened to the second upper middle ring on the front side of the bag body.

2. The convertible bag of claim 1 further comprising a retractable cord having a proximal end and distal end, said proximal end connected to a retracting reel mechanism fixedly attached to the bag body and said distal end fitted with a clip.

3. The convertible bag of claim 1 in which the first and second straps are of equal length.

4. The convertible bag of claim 1 further comprising a placket incorporating the top opening, said placket comprising strips connected to the front side and back side of the bag body, in which the first and second upper buttons of the front side, the first and second upper rings of the front side, the first and second upper buttons of the back side, and the first and second upper rings of the back side are configured such that when in the convertible bag is in the cross body or shoulder bag configuration the placket forms a valley shape in which the opening resides and when the convertible bag is in the backpack configuration the placket forms a substantially planar configuration.

5. The convertible bag of claim 1 in which the back side further comprises a first middle ring and a second middle ring, said rings generally aligned horizontally and selectively attachable to one or more straps.

6. A convertible bag for carrying articles comprising:

a bag body comprising a front side, a back side, underside, and a top opening;

said front side having top, middle, and bottom portions and first and second vertical halves;

said back side having top, middle, and bottom portions and first and second vertical halves that align with the first and second vertical sides of the front panel;

said front side further having a first connectable element located on the upper portion of the first vertical half, a second connectable element located on the middle portion of the first vertical half, a third connectable element located on the lower portion of the first half, a fourth connectable element located on the upper portion of the second vertical half, a fifth connectable element located on the middle portion of the second vertical half, and a sixth connectable element located on the lower portion of the second half;

said back side further having a seventh connectable element located on the upper portion of the first vertical half, an eighth connectable element located on the lower portion of the first half, a ninth connectable element located on the upper portion of the second vertical half, and a tenth connectable element located on the lower portion of the second half;

a first strap having a proximal end and a distal end, further having an eleventh connectable element at the proximal end capable of selective attachment to the first, second, or third connectable elements, a twelfth connectable element positioned from the proximal end by a distance substantially equal to the distance between the first and second connectable elements and capable of selective attachment to the first connectable element, a thirteenth connectable element positioned from the proximal end by a distance substantially equal to the distance between the first and third connectable elements and capable of selective attachment to the first connectable element, a fourteenth connectable element at the distal end capable of attachment to the second, fourth, or sixth connectable elements, a fifteenth connectable element positioned from the distal end by a distance substantially equal to the distance between the second and third connectable elements and capable of selective attachment to the third element, a sixteenth connectable element positioned from the distal end by a distance substantially equivalent to the distance between the fourth and sixth connectable elements and capable of selective attachment to the fourth connectable element, a seventeenth connectable element positioned from the distal end by a distance substantially equal to the shortest distance between the second and eighth connectable elements via the underside of the bag and capable of the selective attachment to the eighth connectable element;

a second strap having a proximal end an a distal end, further having an eighteenth connectable element at the proximal end capable of selective attachment to the fifth, seventh, or eighth connectable elements, a nineteenth connectable element positioned from the proximal end by a distance substantially equal to the distance between the fourth and fifth connectable elements and capable of selective attachment to the fourth connectable element, a twentieth connectable element positioned from the proximal end by a distance substantially equal to the distance between the seventh and eighth connectable elements and capable of selective attachment to the seventh connectable element, a twenty-first connectable element at the distal end capable of attachment to the fifth, ninth, or tenth connectable elements, a twenty-second connectable element positioned from the distal end by a distance substantially equal to the distance between the fifth and sixth connectable elements and capable of selective attachment to the sixth connectable element, a twenty-third connectable element positioned from the distal end by a distance substantially equivalent to the distance between the ninth and tenth connectable elements and capable of selective attachment to the ninth connectable element, a twenty-fourth connectable element positioned from the distal end by a distance substantially equal to the shortest distance between the fifth and tenth connectable elements via the underside of the bag and capable of the selective attachment to the tenth connectable element;

wherein, said first and second straps are connected to the bag body in a configuration selected from the group consisting of cross body configuration, shoulder bag configuration, and backpack configuration;

wherein the cross body bag configuration comprises the first connectable element fastened to the eleventh connectable element, the fourth connectable element fastened to the fourteenth connectable element, the seventh connectable element fastened to the eighteenth connectable element, and the ninth connectable element fastened to the twenty first connectable element;

further wherein the shoulder bag configuration comprises the first connectable element fastened to the thirteenth connectable element, the third connectable element fastened to the eleventh connectable element, the fourth connectable element to the sixteenth connectable element, the sixth connectable element fastened to the fourteenth connectable element, the seventh connectable element fastened to the twentieth connectable element, the eighth connectable element fastened to the eighteenth connectable element, the ninth connectable element fastened to the twenty-third connectable element, and the tenth connectable element fastened to the twenty first connectable element; and further wherein the backpack configuration comprises the first connectable element fastened to the twelfth connectable element, the second connectable element to the eleventh connectable element, the third connectable element fastened to the fifteenth connectable element, the fourth connectable element to the nineteenth connectable element, the fifth connectable element to the eighteenth connectable element, the sixth connectable element to the twenty-second connectable element, the eighth connectable element fastened to the seventeenth connectable element, the tenth connectable element fastened to the twenty-fourth connectable element, the second connectable element to the fourteenth connectable element, and the fifth connectable element fastened to the twenty first connectable element.

7. The convertible bag of claim 6 in which said connectable elements are selected from a group consisting of D rings, circular rings, rectangular rings, triangular rings, loops, brackets, snap fasteners, belt loops, straps, eyes, hooks, hoops, buckles, clamps, clasps, cords, twist ties, bayonet fittings, Chicago screws, grommets, chocks, and chock retainers.

8. The convertible bag of claim 6 in which the first, fourth, seventh, and ninth connectable elements consist of a button positioned above a ring; the third, sixth, eighth, and tenth connectable elements consist of a ring positioned above a button, the second and fifth connectable elements consist of a first ring positioned above a second ring; the eleventh, fourteenth, eighteenth, and twenty first connectable elements consist of clips, and the twelfth, thirteenth, fifteenth, sixteenth, seventeenth, nineteenth, twentieth, twenty second, twenty third, and twenty-fourth connectable elements consist of slots.

9. The convertible bag of claim 6 in which the first and second straps are of equal length.

10. The convertible bag of claim 6 further comprising a placket incorporating the top opening, said placket comprising strips attached to the front side and back side of the bag body, in which the first, fourth, seventh, and ninth connectable elements are configured such that when in the convertible bag is in cross body or shoulder bag configuration the placket forms a valley shape in which the opening resides and when the convertible bag is in the backpack configuration the placket forms a substantially planar configuration.

11. The convertible bag of claim 6 in which the bag has a first panel and a second panel opposedly connected to the front side, back side, and underside and further comprising a placket incorporating the top opening, said placket comprising strips attached to the front side and back side of the bag body and free of the first and second panels, in which the first, fourth, seventh, and ninth connectable elements are configured such that when in the convertible bag is in cross body or shoulder bag configuration the placket forms a valley shape in which the opening resides and when the convertible bag is in the backpack configuration the placket forms a substantially planar configuration.

12. The convertible bag of claim 6 further comprising a retractable cord having a proximal end and distal end, said proximal end connected to a retracting reel mechanism fixedly attached to the bag body and said distal end fitted with a clip.

13. A convertible bag for carrying articles comprising:

a bag body comprising a front side, a back side, underside, and a top opening;

said front side having top, middle, and bottom portions and first and second vertical halves;

said back side having top, middle, and bottom portions and first and second vertical halves that align with the first and second vertical sides of the front panel;

said front side further having a first connectable element located on the upper portion of the first vertical half, a second connectable element located on the middle portion of the first vertical half, a third connectable element located on the lower portion of the first half, a fourth connectable element located on the upper portion of the second vertical half, a fifth connectable element located on the middle portion of the second vertical half, and a sixth connectable element located on the lower portion of the second half;

said back side further having a seventh connectable element located on the upper portion of the first vertical half, an eighth connectable element located on the lower portion of the first half, a ninth connectable element located on the upper portion of the second vertical half, and a tenth connectable element located on the lower portion of the second half;

a first strap having a proximal end and a distal end, further having a proximal end connectable element at the proximal end and a plurality of additional proximal end connectable elements near the proximal end, and further having a distal end connectable element at the distal end and a plurality of additional distal end connecting elements near the distal end;

a second strap having a proximal end and a distal end, further having a proximal end connectable element at the proximal end and plurality of additional proximal end connectable elements near the proximal end, and further having a distal end connectable element at the distal end and a plurality of additional distal end connecting elements near the distal end;

wherein, said first and second straps are connected to the bag body in a configuration selected from the group consisting of cross body configuration, shoulder bag configuration, and backpack configuration;

wherein the cross body bag configuration comprises the first connectable element fastened to the proximal end connectable element of the first strap, the fourth connectable element fastened to the distal connectable element of the first strap, the seventh connectable element fastened to the proximal connectable element of the second strap, and the ninth connectable element fastened to the distal end connectable element of the second strap;

further wherein the a shoulder bag configuration comprises the third connectable element fastened to the proximal end connectable element of the first strap, the first connectable element to one of the additional proximal end connectable elements of the first strap, the sixth connectable element fastened to the distal end connectable element of the first strap, the fourth connectable element to one of the additional distal end connectable elements of the first strap, the eighth connectable element fastened to the proximal connectable element of the second strap, the seventh connectable element to one of the additional proximal end connectable elements of the second strap, the tenth connectable element fastened to the distal end connectable element of the second strap, and the ninth connectable element to one of the additional distal end connectable elements of the second strap; and further wherein the backpack configuration comprises the second connectable element fastened to the proximal end connectable element of the first strap, the first connectable element to one of the additional proximal end connectable elements of the first strap, the eighth connectable element to one of the additional distal end connectable elements of the first strap, the third connectable element to another of the additional distal end connectable elements of the first strap, the second connectable element fastened to the distal end connectable element of the first strap, the fifth connectable element fastened to the proximal end connectable element of the second strap, the fourth connectable element to one of the additional proximal end connectable elements of the second strap, the tenth connectable element to one of the additional distal end connectable elements of the second strap, the sixth connectable element to another of the additional distal end connectable elements of the second strap, and the fifth connectable element fastened to the distal end connectable element of the second strap.

14. The convertible bag of claim 13 in which said connectable elements are selected from a group consisting of D rings, circular rings, rectangular rings, triangular rings, loops, brackets, snap fasteners, belt loops, straps, eyes, hooks, hoops, buckles, clamps, clasps, cords, twist ties, bayonet fittings, Chicago screws, grommets, chocks, and chock retainers.

15. The convertible bag of claim 13 in which the first, fourth, seventh, and ninth connectable elements consist of a button positioned above a ring; the third, sixth, eighth, and tenth connectable elements consist of a D ring positioned above a button, the second and fifth connectable elements consist of a first D ring positioned above a second D ring; the proximal and distal end connectable elements of the first and second straps consist of clips, and the additional proximal and distal end connectable elements consist of slots.

16. The convertible bag of claim 13 in which the first and second straps are of equal length.

17. The convertible bag of claim 13 further comprising a placket incorporating the top opening, said placket comprising strips attached to the front side and back side of the bag body, in which the first, fourth, seventh, and ninth connectable elements are configured such that when in the convertible bag is in cross body or shoulder bag configuration the placket forms a valley shape in which the opening resides and when the convertible bag is in the backpack configuration the placket forms a substantially planar configuration.

18. The convertible bag of claim 13 in which the bag has a first panel and a second panel opposedly connected to the front side, back side, and underside and further comprising a placket incorporating the top opening, said placket comprising strips attached to the front side and back side of the bag body and free of the first and second panels, in which the first, fourth, seventh, and ninth connectable elements are configured such that when in the convertible bag is in cross body or shoulder bag configuration the placket forms a valley shape in which the opening resides and when the convertible bag is in the backpack configuration the placket forms a substantially planar configuration.

19. The convertible bag of claim 13 further comprising a retractable cord having a proximal end and distal end, said proximal end connected to a retracting reel mechanism fixedly attached to the bag body and said distal end fitted with a clip.

* * * * *